US006718620B2

(12) United States Patent
Paasch et al.

(10) Patent No.: US 6,718,620 B2
(45) Date of Patent: Apr. 13, 2004

(54) METHOD FOR THE MANUFACTURE OF AN ELECTROMAGNETIC ACTUATOR

(75) Inventors: Rudolf Paasch, Filderstadt (DE); Bernhard Ziegler, Rechberghausen (DE)

(73) Assignee: DaimlerChrysler AG, Stuttgart (DE)

( * ) Notice: Subject to any disclaimer, the term of this patent is extended or adjusted under 35 U.S.C. 154(b) by 237 days.

(21) Appl. No.: 09/920,058

(22) Filed: Aug. 1, 2001

(65) Prior Publication Data

US 2002/0066176 A1 Jun. 6, 2002

(30) Foreign Application Priority Data

Aug. 1, 2000 (DE) ..... 100 37 399

(51) Int. Cl.[7] ..... H01F 7/06

(52) U.S. Cl. ..... 29/602.1; 29/592.1; 29/596; 29/729; 29/888.01; 219/121.63; 219/121.64; 219/121.78; 251/129.09; 251/129.19; 251/129.2

(58) Field of Search ..... 29/592.1, 596, 29/602.1, 840, 598, 729, 888.01; 219/121.63, 121.64, 121.78; 251/129.09, 129.19, 129.2; 137/315.03

(56) References Cited

U.S. PATENT DOCUMENTS 4,515,343 A * 5/1985 Pischinger et al. ..... 251/48
5,131,624 A * 7/1992 Kreuter et al. ..... 251/129.18
5,645,019 A * 7/1997 Liang et al. ..... 123/90.11
5,772,179 A * 6/1998 Morinigo et al. ..... 251/129.1
5,897,796 A * 4/1999 Forrest ..... 219/121.64

FOREIGN PATENT DOCUMENTS

DE 197 12 056 1/1998
DE 19724900 A1 * 12/1998 ..... F01L/3/00
DE 19805177 A1 * 8/1999 ..... F01L/9/04

OTHER PUBLICATIONS

"A new basic technology for magnetic micro–actuators", Fullin, E.; Gobet, J.; Tilmans, H.A.C.; Bergqvist, J.; The Eleventh Annu International Workshop on , Jan. 25–29, 1998, pp. 143–147.*

* cited by examiner

*Primary Examiner*—A. Dexter Tugbang
*Assistant Examiner*—Paul D. Kim
(74) *Attorney, Agent, or Firm*—Kenyon & Kenyon

(57) ABSTRACT

A method is for the manufacture of an electromagnetic actuator, e.g., for the actuation of a charge cycle valve of an internal combustion engine. The actuator includes a rotary armature movable back and forth by electromagnets and supported in an actuator frame The electromagnets are first inserted loosely into the actuator frame and then brought into a defined spatial position in relation to the rotary armature by passing a current through the magnet. Next, the electromagnets are fixed in the actuator frame, corresponding to selected operating positions. The electromagnet may be provided with studs, which protrude through openings in the actuator frame into the outer chamber of the actuator and at which the electromagnet is connected to the actuator frame, for example, by laser beam welding.

20 Claims, 5 Drawing Sheets

METHOD FOR THE MANUFACTURE OF AN ELECTROMAGNETIC ACTUATOR

FIELD OF THE INVENTION

The present invention relates to a method for the manufacture of an electromagnetic actuator, especially of an actuator for the actuation of a charge cycle valve of an internal combustion engine.

BACKGROUND INFORMATION

German Published Patent Application No. 197 12 056 describes an electromagnetic actuator, especially for the actuation of a charge cycle valve of an internal combustion engine. The actuator includes two opposing electromagnets and a rotary armature reciprocating between them, which when the magnets are de-energized is held by spring forces in an intermediate position between the electromagnets, and when one of the electromagnets is energized is brought into a limit position in proximity to the pole faces of the corresponding electromagnet. The rotary armature is connected to the part to be driven, in this case the stem of the charge cycle valve, so that opening and closing of the valve can be performed by alternating actuation of the electromagnets.

The energy needed by the closing magnet and the opening magnet, also referred to as catching energy, in order to attract the rotary armature from a certain distance increases exponentially with the distance. Furthermore, the greater the gap between the attracted rotary armature and the pole face of the activated electromagnet, the greater the holding energy needed to hold the rotary armature in the open or closed position. In order to minimize the efficiency losses, therefore, the pole faces of the electromagnets must be oriented very accurately in relation to the swivel axis of the rotary armature, so that in operation the contact face of the rotary armature bears as accurately as possible on the pole face of the electromagnet activated at any time. This result can be achieved only by a high dimensional stability of the individual components of the actuator and by a highly accurate orientation of the individual elements in relation to one another. The associated expenditure for machining and assembly is extremely high, resulting in considerable costs. Furthermore, the many positional and angular parameters that have to be taken into account present an extremely complex assembly problem, which renders series production of such actuators virtually unfeasible.

It is therefore an object of the invention therefore is to propose a method of assembly for the manufacture of actuators, which is unsusceptible to production inaccuracies of individual components and which at the same time minimizes the efficiency losses in operation.

SUMMARY

The above and other beneficial objects of the present invention are achieved by providing a method as described herein.

According to one example embodiment of the present invention, the electromagnet is first inserted loosely into an actuator frame, in relation to which the swivel axis of the rotary armature is fixed by way of bearing points. The electromagnet is then brought into a defined operating position in relation to the rotary armature. In this spatial and angular position of the electromagnet relative to the rotary armature, the electromagnet is permanently fixed in relation to the frame, so that the spatial and angular position of the electromagnet in relation to the frame is fixed. As a result, the electromagnet is consequently also selectively connected in relation to the swivel axis of the rotary armature, fixed to the frame.

The defined operating position of the electromagnet may be adjusted in relation to the rotary armature by passing a current through the electromagnet. If a current is passed through the electromagnet, a force field is built up between the pole face of the electromagnet and the contact face of the rotary armature arranged opposite the pole face, the force field pulling the electromagnet into a spatial and angular position relative to the rotary armature that is advantageous from various energy standpoints. In this relative position, the electromagnet is oriented in relation to the rotary armature so that the contact face of the rotary armature bears on the pole face of the activated electromagnet, minimizing the intermediate air gap. This arrangement therefore corresponds to the desired orientation between electromagnet and rotary armature, in which efficiency losses in the operating condition may be minimized. The electromagnet is permanently fixed in this spatial and angular position in relation to the frame, so that the spatial and angular position of the electromagnet relative to the frame, assumed while a current was being passed through, is fixed. As a result, the electromagnet is therefore also fixed in relation to the swivel axis of the rotary armature, fixed to the frame, so that the meeting between the pole face of the electromagnet and the contact face of the rotary armature is optimized from the energy standpoint when a current is passed through the electromagnet—and hence in the operating condition of the actuator.

At the same time, this positional and angular orientation and subsequent fixing of the electromagnet relative to the rotary armature is achieved entirely regardless of production inaccuracies of these two components. There is a single reference point in assembling the electromagnet, and this reference point is defined solely by the orientation of the pole face, which bears against the contact face of the rotary armature. All other dimensions of the electromagnet play no part in this reference point and may therefore contain, e.g., production, inaccuracies. It is also possible through orientation of the electromagnet on the contact face of the rotary armature, to compensate for any positional inaccuracies of the swivel axis of the rotary armature in the frame. The method according to the present invention therefore permits a considerable reduction in production costs, since expensive machining of selected strike faces and assembly faces is no longer necessary for highly accurate orientation of the electromagnet. This arrangement obviates the need for a precise dimensional stability of components, and a reduction in production costs may be achieved through the avoidance of fine production tolerances and linked series of tolerances.

Furthermore, the method includes only a few, simple stages. It is therefore cost-effective and suitable for mass production. Finally, the method ensures that assembly is performed under realistic operating conditions (biasing of the rotary armature, opening and closing positions of the valves). That is, the electromagnet is fixed in a position relative to the rotary armature such that the rotary armature in subsequent operational service bears virtually free of distortion on the pole face of the electromagnet when a current is passed through the electromagnet. This arrangement reduces the bending load on the rotary armature and increases its service life considerably. The efficiency of the actuator system may be increased and its energy demand considerably reduced by the method of assembly according to the present invention, so that the actuator cooling system needs to meet lower requirements or may be eliminated.

The method described above for fixing a single electromagnet in an actuator may easily be extended to actuators with two electromagnets, the pole faces of which at least partially face one another. In this case, two electromagnets are first arranged loosely in the actuator frame, in relation to which the swivel axis of the rotary armature is fixed by way of bearing points. The rotary armature is then brought into a first defined operating position and fixed in this position. By passing a current through the first electromagnet (i.e., that corresponding to this operating position), this electromagnet is brought into the most favorable spatial and angular position from the energy standpoint corresponding to this operating position and in this position is fixed in relation to the frame. The rotary armature is then brought into a second defined operating position and is temporarily fixed in this position. By passing a current through the second electromagnet (i.e., that corresponding to the second operating position), this second electromagnet is brought into a spatial and angular position, which corresponds to a minimization of the gap between the pole face of the second electromagnet and the contact face of the rotary armature opposite the pole face, and in this position is fixed in relation to the frame. In the method according to the present invention, therefore, the positioning and fixing of each electromagnet is performed in isolation from the other electromagnet. The costly and error-prone simultaneous assembly of both electromagnets necessary in conventional production methods is therefore eliminated.

In order to achieve the minimum possible deformation of the electromagnets and of the frame during fixing of the electromagnet and thereby to obtain an assembled state that is as stress-free as possible, the electromagnet may be fixed by a low-distortion joining method. The use of laser welding has proved particularly advantageous in this context, since it ensures a rapid joining of the two joined parts with localized, strictly limited heat input.

With regard to the actual form of the joint area between electromagnet and frame, the electromagnet may be provided with a protruding stud, which in the actuator assembly position projects through an opening in the wall of the frame into the outer chamber. When a current is passed through the electromagnet as described above, the stud fixed to the magnet assumes a certain spatial and angular position, in which it must be fixed in relation to the frame. This fixing is achieved by a fixed connection of the end of the stud projecting outwardly through the frame wall to the frame. The actual joint area may thereby be situated in the outer area of the actuator, which considerably improves the visibility and accessibility of the joint, thereby substantially facilitating the joining process.

In order to avoid distortions of the rotary armature the opening in the frame wall, through which the end of the stud is fed, must be designed with sufficiently large dimensions so that—irrespective of the production inaccuracies of the components to be assembled—the stud may be fed through the opening unimpeded without touching the edges of the opening when a current is passed through the electromagnet. In the energized state of the electromagnet there is therefore a peripheral gap between the stud and the edges of the opening that has to be bridged by the joining process. To bridge this gap, a connecting element may be used, which bears flatly on the frame. The connecting element is first positioned without a gap in relation to the stud and joined to the stud. The connecting element is then joined to the frame in the overlap area. This arrangement allows the stud end to be fixed in any spatial and angular position in relation to the frame opening.

DETAILED DESCRIPTION

Figure 1:
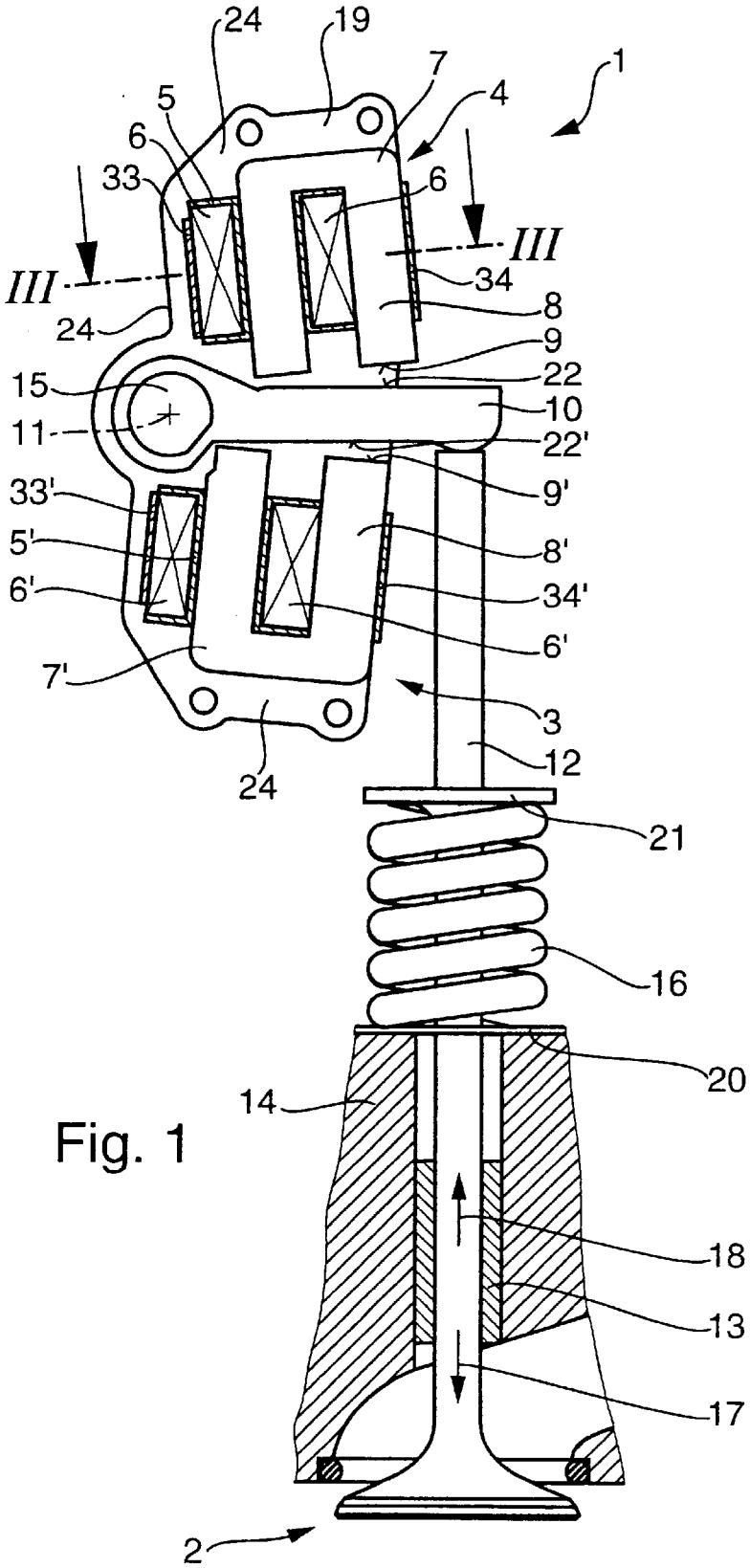
FIG. 1 is a schematic longitudinal cross-sectional view of an actuator.
Figure 2:
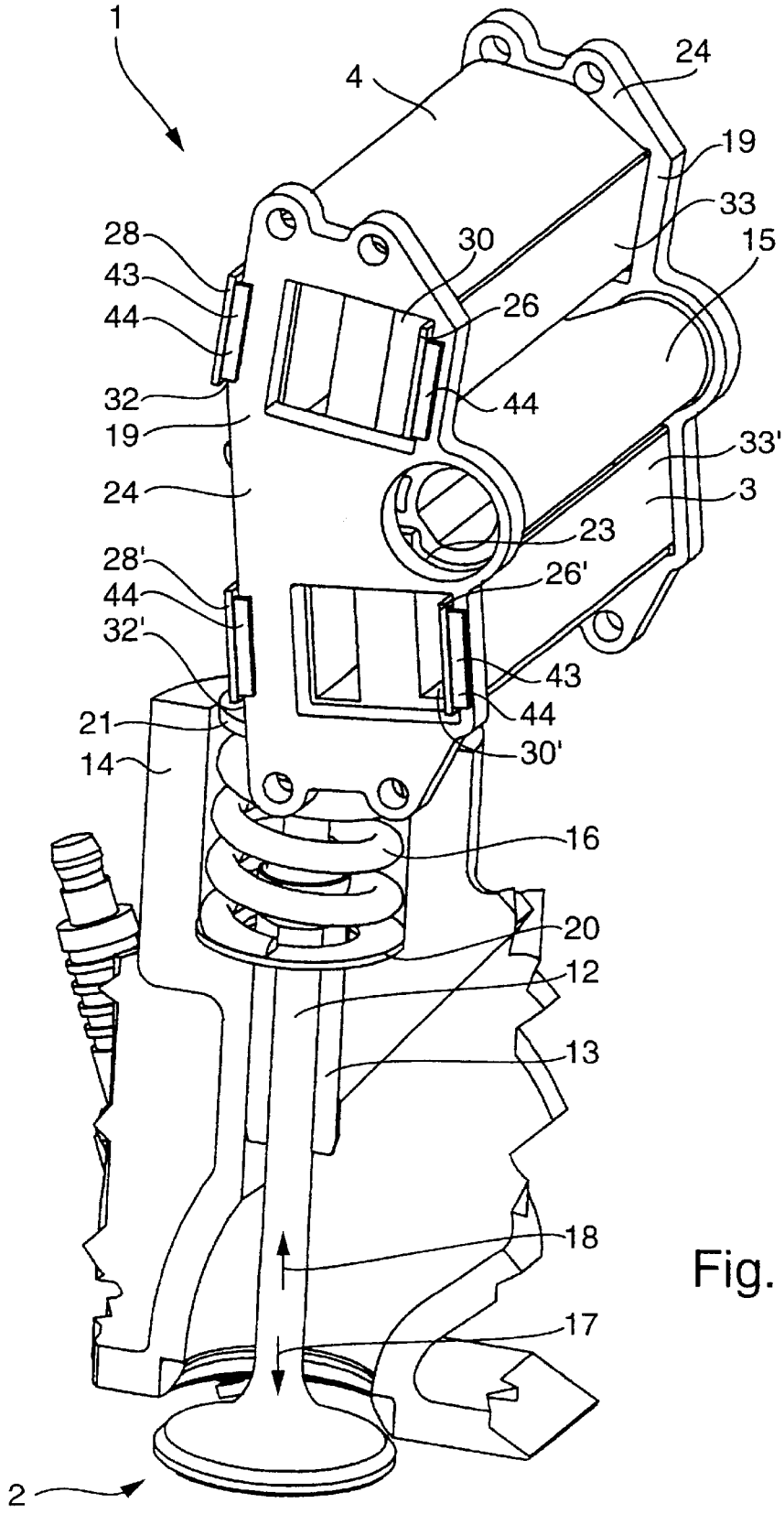
FIG. 2 is a schematic perspective view of the actuator.

FIGS. 1 and 2 illustrate an electromagnetic actuator 1 for the actuation of a charge cycle valve 2 of an internal combustion engine. The actuator 1 includes an electromagnetic unit with two electromagnets 3, 4 (opening magnet 3 and closing magnet 4). Each of the electromagnets 3, 4 includes a magnetic coil 6, 6' wound on a coil carrier 5, 5' and a core 7, 7' with two yoke legs 8, 8', the end faces of which form pole faces 9, 9'. A rotary armature 10 is supported between the pole faces 9, 9' so that it may swivel about a swivel axis 11. The rotary armature 10 acts by way of a valve stem 12 on the charge cycle valve 2. The valve stem 12 is supported by way of a stem guide 13 so that it is axially displaceable in a cylinder head 14 of the internal combustion engine.

In addition, the actuator 1 includes a spring mechanism having two biased valve springs 15, 16, one valve spring 15 in the form of a torsion spring acting in the opening direction 17, and one valve spring 16 in the form of a helical compression spring acting in the closing direction 18. The torsion spring 15 serves as bearing for the rotary armature 10, is supported on the actuator frame 19 and acts by way of the valve stem 12 on the charge cycle valve 2. The helical compression spring 16 is supported by way of a first spring seat 20 on the cylinder head 14 and acts by way of a second spring seat 21 and by way of the valve stem 12 on the charge cycle valve 2. When the electromagnets 3, 4 are de-energized, the rotary armature 10 is held by the valve springs 15, 16 in an equilibrium position between the pole faces 9, 9' of the electromagnets 3, 4.

In order to ensure a low-loss switching of the rotary armature 10 by the electromagnets 3, 4, there must be a highly accurate orientation of the spatial and angular position of the electromagnets 3, 4 in relation to the rotary armature. In particular, each electromagnet 3, 4 must be arranged so that in the energized state of the electromagnets 3, 4, the contact face 22, 22' of the rotary armature 10 bears on the pole face 9, 9' of the respective electromagnet with a minimal, if any, gap.

The method of assembly according to the present invention is used for assembly of the actuator 1 with the object of achieving such a highly accurate orientation of the electromagnets 3, 4 in relation to the rotary armature 10. To this end, the electromagnets 3, 4 and the rotary armature 10 are first inserted into the actuator frame 19. In so doing, the rotary armature 10 is fixed by way of its two bearings 23 in relation to the actuator frame, whereas the electromagnets 3, 4 are loosely inserted into the actuator frame.

Figure 3:
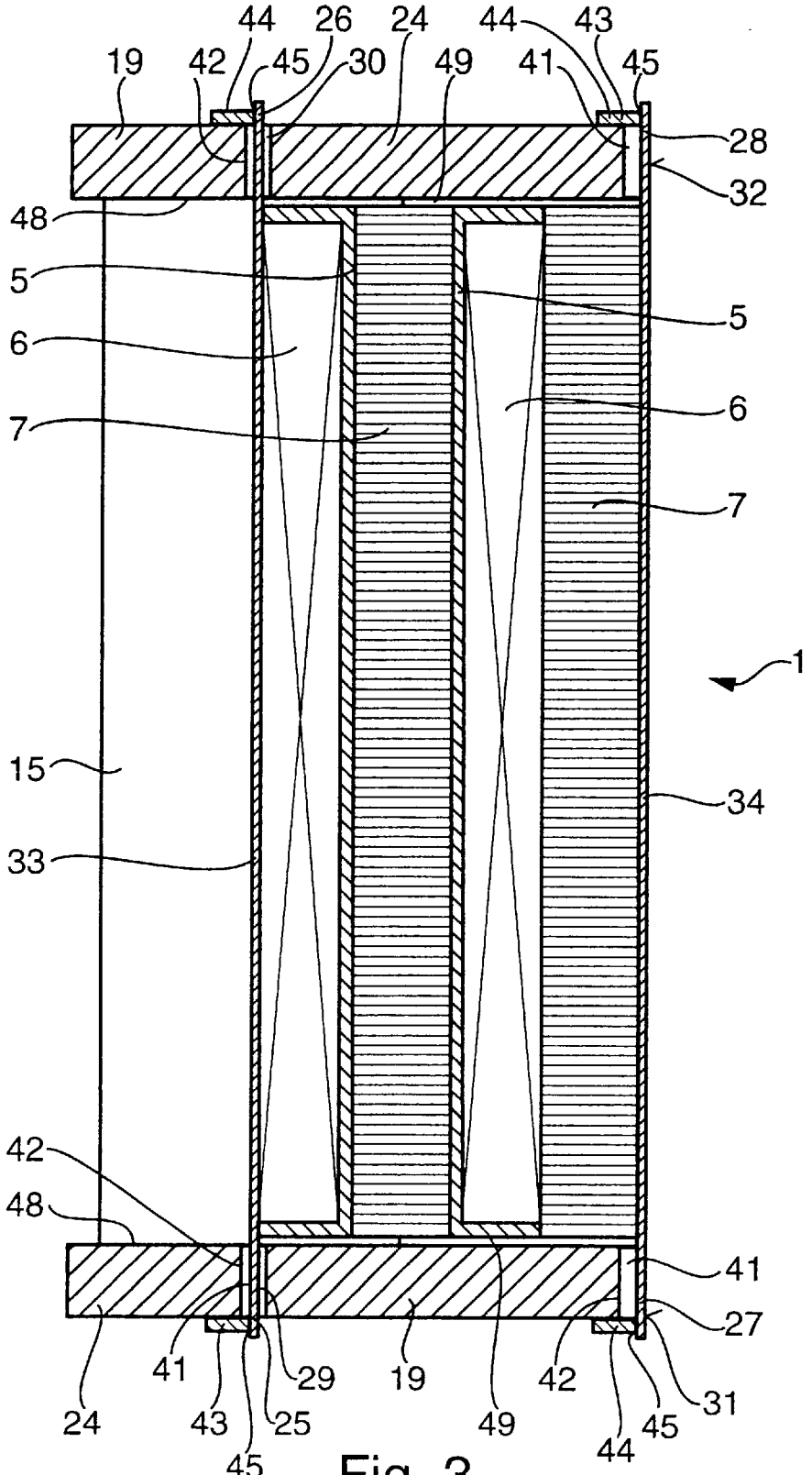
FIG. 3 is a schematic axial cross-sectional view of the actuator illustrated in FIG. 1 taken along the line III—III.

In this example embodiment, the actuator frame includes two end plates 24, which define the ends of the actuator in the direction of the swivel axis 11. As illustrated in FIG. 3, each electromagnet 3, 4 includes two studs 25-28 protruding in the direction of each end plate 24, the studs in the assembly position projecting through openings 29-32 in the end plates 24 into the outer chamber of the actuator 1 (see FIG. 3). In this example embodiment, the openings 29 and 30 are formed by holes in the end plates 24, whereas the openings 31 and 32 are formed through edge areas of the end plates 24. The studs 25, 26 therefore protrude through the end plates 24, whereas the studs 27, 28 project laterally past the end plates 24 in immediate proximity to the end plates 24.

At the beginning of the assembly process, the rotary armature 10 is connected at each of its two bearing points 23 to an end plate 24, so that the two end plates 24 are fixed relative to one another by way of the rotary armature 10. The electromagnets 3, 4 are inserted loosely between the two end plates 24, the studs 25-28, protruding in the direction of the end plates 24, extending through the openings 29-32 in the end plates 24.

In the present example embodiment, the studs 25-28 of the electromagnets 3, 4 are formed as end extensions of fixing clamps 33, 34, which laterally limit the yoke legs 8 of the electromagnets 3, 4. Alternative configurations for the studs 25-28 are also possible, however, as axial extensions of the cores 7, as additional elements provided on the ends of the electromagnets 3, 4, etc.

Figure 4A:
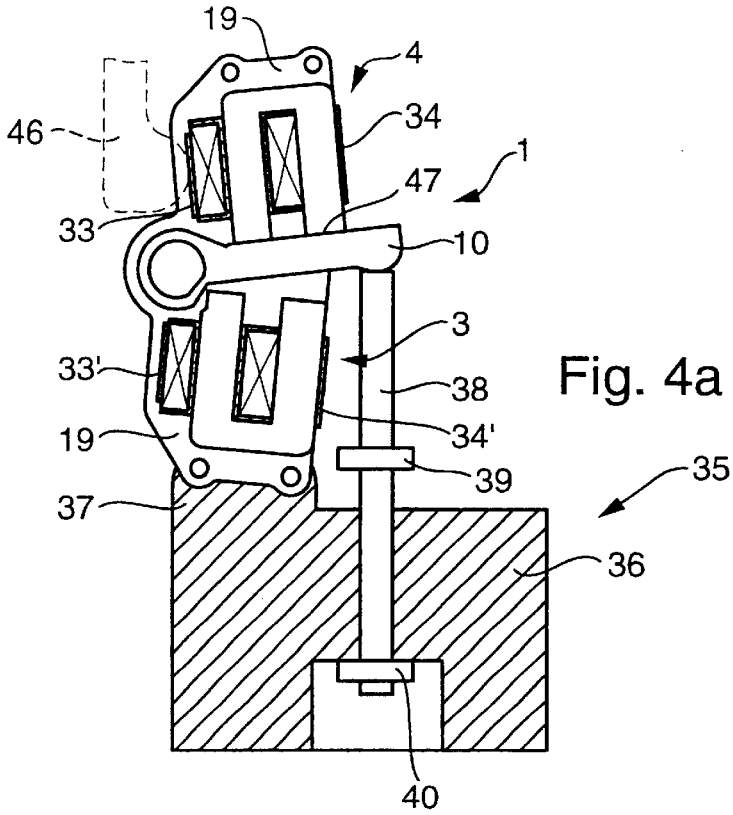
FIG. 4*a* is a schematic view of the actuator when fixing a closing magnet.
Figure 4B:
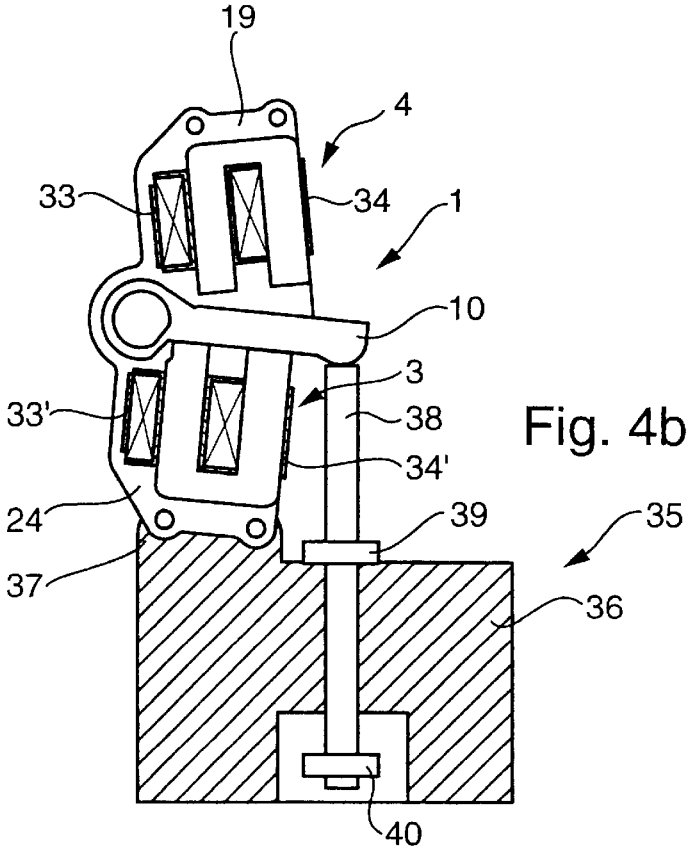
FIG. 4*b* is a schematic view of the actuator when fixing an opening magnet.

Once the electromagnets 3, 4 have been loosely inserted into the actuator frame 1, the next steps of the method according to the present invention include determining and fixing the optimum positions of the opening magnet 3 and the closing magnet 4 in relation to the rotary armature 10 in the opening and closing position respectively of the valve 2. For this purpose, an adjustment fixture 35 is used, by which the two operating positions of the valve 2 can be simulated (see FIGS. 4*a* and 4*b*). The adjustment fixture 35 includes a basic body 36 with a reference mount 37 and a tappet 38, which is guided, axially displaceable in the basic body 36. The tappet 38 includes two flanges 39, 40, by which the tappet 38 may be shifted into two defined limit positions, "valve open" and "valve closed", in relation to the basic body 36. The reference mount 37 of the adjustment fixture 35 serves for accurate positioning of the actuator 1 in relation to the adjustment fixture 35 and is configured so that it corresponds to the seat for the actuator 1 on the internal combustion engine, thereby ensuring that, in the assembled position with the adjustment fixture 35, the actuator 1 assumes the same spatial position in relation to the tappet 38 as in relation to the valve 2 in the assembly position with the internal combustion engine. By the tappet 38, the rotary armature 10 may therefore be pressed into the two limit positions corresponding to the open and closed position of the valve 2. In the example embodiment illustrated in FIGS. 4*a* and 4*b*, the reference mount 37 is illustrated schematically by screw fastening points at which the actuator frame 19 is screwed to the adjustment fixture 35.

The first step is to identify the optimum position of the closing magnet 4 in relation to the rotary armature 10 in the closed position of the valve 2 and to fix the closing magnet 4 in this position. For this purpose, the tappet 38 of the adjustment fixture 35 is shifted into the "valve closed" limit position, so that, against the spring force of the torsion spring 15, the rotary armature 10 of the actuator 1 is pressed into the position corresponding to the open position of the valve 2. A current is passed through the closing magnet 4 loosely inserted in the actuator frame 19. As a result, the closing magnet 4 experiences an attractive force toward the rotary armature 10, which pulls it into the most favorable spatial position, from the energy standpoint, relative to the rotary armature 10 (see FIG. 4*a*). This arrangement corresponds precisely to the desired gap-minimizing position, which, in operation of the actuator 1, ensures loss-minimizing switching and holding of the rotary armature 10. In this position, the closing magnet 4 is fixed in relation to the actuator frame 19 by fixing the studs 25-28 protruding at both sides through the openings in the end plates 24 to the respective end plate 24. To bridge the gaps 41 between the studs 25-28 and the walls 42 of the openings 29-32, connecting elements 43 are used, which are each connected to a stud 25-28 and to an end plate 24. In this instance, the connecting elements 43 are formed by a metal platelet 44, which platelets bear flatly on the end plates 24 and are thus displaced in relation to the studs 25-28, so that they bear laterally on the respective stud 25-28. In this position, the platelets 44 are fixed to the respective stud 25-28 and to the end plate 24. The closing magnet 4 is thereby fixed in the desired position in relation to the end plates 24.

The next step is to adjust the optimum position of the opening magnet 3 in relation to the rotary armature 10 in the open position of the valve 2 and to fix the opening magnet 3 in this position. To do this, the tappet 38 of the adjustment fixture 35 is pulled back into the "valve open" limit position (with, both electromagnets 3, 4 in a de-energized state), so that the rotary armature 10 of the actuator 1 is moved into the position corresponding to the closed position of the valve 2 by the spring force of the torsion spring 15. A current is passed through the opening magnet 3 loosely inserted in the actuator frame 19. The opening magnet is thereby pulled into the most favorable spatial position, from the energy standpoint, in relation to the rotary armature 10, which corresponds precisely to the desired gap-minimizing position of the opening magnet 3 in relation to the rotary armature 10. In this position, the opening magnet 3 is fixed in relation to the actuator frame 19 by fixing the studs 25'-28' protruding at both sides through the openings 29'-32' in the end plates 24 to the respective end plate 24—in the same way as for fixing the closing magnet 4. Metal platelets 49, which are fixed both to the respective stud 25'-28' and to the respective end plate 24, are used to bridge the gaps 41 between the studs 25'-28' and the walls 42' of the openings 29'-32'. The two electromagnets 3, 4 are therefore fixed in such a position in relation to the rotary armature 10 that low-loss switching and holding of the rotary armature 10 in the actuator is ensured.

Laser welding may be suitable as a joining method for connecting the connecting element 43 to the studs 25-28 and the end plates 24, since it requires little processing time and results in minimal distortions of the welded components. Such a low-distortion connection may be necessary in order to ensure substantially stress-free suspension of the electromagnets 3, 4 in relation to the end plates 24 and hence also in relation to the rotary armature 10. In order to achieve positionally accurate fixing of the metal platelet 44, the metal platelet 44 is first welded continuously to the stud 25-28 and then welded to the end plate 24. For precise positioning of the laser weld seams 50, in automated mass production a, e.g., optical, seam tracking system may be used, which ensures that the laser weld seam is reliably located in the contact area 45 of stud 25-28 and metal platelet 44. Other joining methods may also be used as alternatives to laser welding.

In the present example embodiment, the studs 25-28 are formed by metal strips protruding axially from the electromagnets 3, 4. The studs 25-28 therefore have a certain flexibility in response to bending and oscillations, which leads to a certain "softness" of the assembled system. If a firmer connection of the electromagnets 3, 4 to the actuator 19 is to be achieved, the studs 25-28 may be provided with reinforcing beads, etc. In addition, the studs may also protrude obliquely from the electromagnet 3, 4, in order to provide the connection between electromagnet 3, 4 and actuator frame 19 with additional, laterally directed force components.

In the method according to the present invention, no current need be passed through the magnets 3, 4 during the actual joining process, it being merely necessary to ensure that during the joining process they remain in the position corresponding to the energized state. Furthermore, it may be advantageous, by stops 46, to reduce the number of degrees of freedom that the electromagnets 3, 4 may assume during the positioning/fixing. Thus, for example, a stop 46', which laterally limits the position of the closing magnet 4 with reference to the distance from the swivel axis 11 of the rotary armature 10 and therefore defines the position of the contact areas 47 of the pole faces relative to the contact faces 22 of the rotary armature 10, is indicated by a dashed line in FIG. 4*a*. In designing the stops 46, it is essential that, when a current is passed through the electromagnets, the stops 46 must not lead to distortions in the position of this electromagnet 3, 4, in order that the suspension of the electromagnet 3, 4 set by the fixing actually corresponds to the optimum position in relation to the rotary armature 10.

Any other adjustment fixture that simulates the defined, e.g., operational, setting of the open and closed position of the valve 2 may also be used instead of the adjustment fixture 35 described above. In particular, the internal combustion engine itself may also be used as adjustment fixture. In this case, the electromagnets 3, 4 are therefore positioned and fixed only after fitting the actuator frame 19 to the internal combustion engine, and the valves 2 themselves are used for adjusting the rotary armature 10 in closed and open position.

Figure 5:
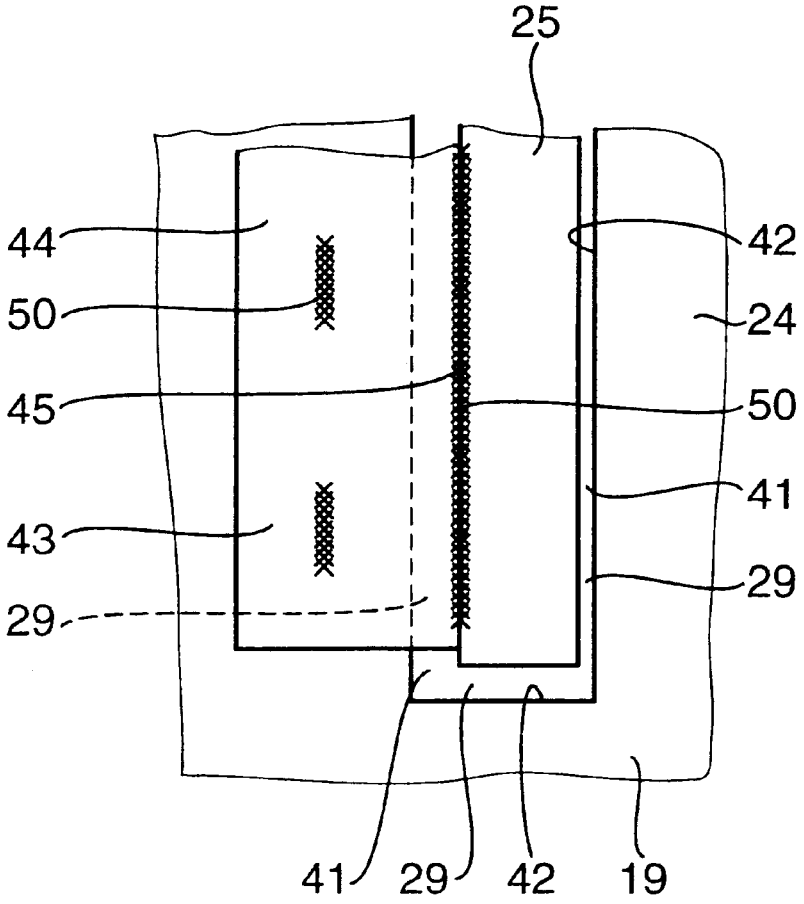
FIG. 5 is a schematic plan view of a connecting area between a stud of an electromagnet and an opening in an end plate.

The openings 29-32 in the end plates 24, through which the studs 25-28 pass in the assembled position, are configured so that after fixing the electromagnets 3, 4, the studs 25-28 do not touch the walls 42 of the openings 29-32 (see FIGS. 3 and 5, which shows a top view of the opening 29). Furthermore, the distance between the inner faces 48 of the end plates 24 in the assembled position is greater than the length of the electromagnets 3, 4, so that in the assembled position there is a gap 49 between the electromagnets 3, 4 and the end plates 24. This arrangement ensures that during positioning of the actuator frame 19, the electromagnets 3, 4 are freely rotatable and displaceable and may therefore be fixed in the optimum operating position in relation to the rotary armature 10, and at the same time are exposed to negligible stresses and distortions by the fixing in relation to the end plates 24. In order to ensure this result, the position and the size of the openings 29-32 in the end plates 24 and the distance between the end plates 24 (or the length of the electromagnets 3, 4) must be matched to the maximum aggregate inaccuracies to be expected in the dimensional stability of the electromagnets 3, 4 and of the rotary armature 10. The size of the gaps 41, 49 is typically a few tenths of a millimeter.

The end plates 24 may take the form of solid, plane metal plates. In order to achieve weight savings, the end plates 24 may also be formed by deep-drawn parts, the thickness of which is less than that of the metal plates and which are provided with rigidity-enhancing structures in order to achieve the necessary bending strength.

It should be appreciated that the use of the method according to the present invention does not necessarily mean that in the finally assembled state the axes of symmetry of the electromagnets 3, 4 will extend parallel to the swivel axis 11 of the rotary armature 10. Particularly when the rotary armature 10 has a certain flexibility and the contact faces, under the force of the valve stem 12, are not only turned about the swivel axis 11 but are also tilted in relation to the swivel axis 11, the method according to the present invention results in nonparallelism of electromagnets 3, 4 and swivel axis 11, since by the nature of the method, the electromagnets 3,4 are adjusted in relation to the contact faces 22, 22' of the rotary armature 10 under operating conditions, not in relation to the swivel axis 11 of the rotary armature 10.

Although it is not absolutely necessary for accurate positioning and fixing of the electromagnets 3, 4 relative to the rotary armature 10, the pole faces 9, 9' of the yoke legs 8, 8' and the contact faces 22, 22' of the rotary armature 10 may be machined flat. Due to the compensatory effect of the assembly method according to the present invention described above, however, these are the only dimensions on the relevant components of the actuator 1 that require precision machining.

Although the method for the adjustment of an actuator 1 has been described above for charge cycle valves that include two electromagnets 3, 4 (opening magnet 3 and closing magnet 4), the method is similarly applicable to actuators 1, which only include one single electromagnet 4. Furthermore, the method may be extended to the adjustment of actuators 1, which include more than two electromagnets (e.g., actuators with a pair of two electromagnets for the actuation of two valves).

While in the method described above, a current is passed through the electromagnets 3, 4 in order to bring them into a defined operating position in relation to the rotary armature 10, corresponding to the open or closed position of the valve 2, other types of force may also be used in order to bring the electromagnets 3, 4 into the selected spatial and angular position. In particular, by utilizing gravity the electromagnets 3, 4 may "drop" into the desired spatial and angular position if during assembly of the electromagnets 3, 4 an appropriate orientation of the actuator 1 is selected, in which the electromagnet to be fixed is pressed on to the rotary armature 10 under the effect of gravity in the desired position. Alternatively or in addition, the electromagnets 3, 4 may be brought into the desired position by directed compressive and/or tensile forces.

What is claimed is:

1. A method for manufacturing an electromagnetic actuator, the actuator including:

at least one electromagnet;

a swivelling rotary armature, the rotary armature being configured to move into a limit position in proximity to a pole face of the electromagnet when the electromagnet is energized; and a frame configured to accommodate the electromagnet and the rotary armature;

the method comprising the steps of:

inserting the electromagnet and the rotary armature into the frame;

fixing a swivel axis of the rotary armature in a bearing point in the frame;

moving the rotary armature into a defined operating position;

moving the electromagnet into a defined operating position relative to the defined operating position into which the rotary armature is moved in the rotary armature moving step;

fixing the electromagnet relative to the frame so that a spatial and angular position of the electromagnet relative to the frame is fixed in the defined operating position into which the electromagnet is moved in the electromagnet moving step.

2. The method according to claim 1, wherein the electromagnet is moved in the electromagnet moving step by passing a current through the electromagnet.

3. The method according to claim 1, wherein the actuator is configured to actuate a charge cycle valve of an internal combustion engine.

4. The method according to claim 1, wherein the electromagnet is fixed in the electromagnet fixing step by a low-distortion joining method.

5. The method according to claim 4, wherein the electromagnet is fixed in the electromagnet fixing step by laser welding.

6. The method according to claim 1, wherein the electromagnet is inserted loosely into the frame in the inserting step.

7. The method according to claim 1, wherein in the defined operating position of the rotary armature and the defined operating position of the electromagnet, the rotary armature is positioned to bear on a pole face of the electromagnet.

8. The method according to claim 1, wherein in the defined operating position of the rotary armature and the defined operating position of the electromagnet, the rotary armature and the electromagnet are separated by a predetermined gap.

9. A method for manufacturing an electromagnetic actuator, the actuator including:

at least one electromagnet;

a swivelling rotary armature, the rotary armature being configured to move into a limit position in proximity to a pole face of the electromagnet when the electromagnet is energized; and a frame configured to accommodate the electromagnet and the rotary armature;

the method comprising the steps of:

inserting the electromagnet and the rotary armature into the frame;

fixing a swivel axis of the rotary armature in a bearing point in the frame;

moving the rotary armature into a defined operating position;

moving the electromagnet into a defined operating position relative to the rotary armature; and fixing the electromagnet relative to the frame so that a spatial and angular position of the electromagnet relative to the frame is fixed in the defined operating position;

wherein the electromagnet is fixed in the electromagnet fixing step in relation to the frame in an area of a connecting stud fixed to the electromagnet and protruding through a wall of the frame into an outer chamber.

10. The method according to claim 9, further comprising the steps of:

connecting an end of the connecting stud protruding into the outer chamber to a connecting element, the connecting element bearing flatly on sections of the frame and displaceable relative to the frame in the spatial and angular position of the electromagnet; and fixing the connecting element relative to the frame after the connecting step.

11. A method for manufacturing an electromagnetic actuator, the actuator including:

two electromagnets, pole faces of the electromagnets at least partially facing each other;

a rotary armature configured to swivel between the pole faces, the rotary armature being configured to move into one of two limit positions in proximity to the pole faces when the electromagnet is energized;

a frame configured to accommodate the electromagnets and the rotary armature;

the method comprising the steps of:

inserting the electromagnets and the rotary armature into the frame;

fixing a swivel axis of the rotary armature in a bearing point in the frame;

moving the rotary armature into a first defined operating position;

moving a first electromagnet into a defined operating position relative to the first defined operating position into which the rotary armature is moved in the step of moving the rotary armature into the first defined operating position;

fixing the first electromagnet relative to the frame so that a spatial and angular position of the first electromagnet is fixed relative to the frame in the defined operating position into which the first electromagnet is moved in the first electromagnet moving step;

moving the rotary armature into a second defined operating position;

moving a second electromagnet into a defined operating position relative to the second defined operating position into which the rotary armature is moved in the step of moving the rotary armature into the second defined operating position; and fixing the second electromagnet relative to the frame so that a spatial and angular position of the second electromagnet is fixed relative to the frame in the defined operating position into which the second electromagnet is moved in the second electromagnet moving step.

12. The method according to claim 11, wherein the first electromagnet is moved in the first electromagnet moving step by passing a current through the first electromagnet and the second electromagnet is moved in the second electromagnet moving step by passing a current through the second electromagnet.

13. The method according to claim 11, wherein the first electromagnet is fixed in the first electromagnet fixing step and the second electromagnet is fixed in the second electromagnet fixing step by a low-distortion method of joining.

14. The method according to claim 13, wherein the first electromagnet is fixed in the first electromagnet fixing step and the second electromagnet is fixed in the second electromagnet fixing step by laser welding.

15. The method according to claim 11, wherein the electromagnets are inserted loosely into the frame in the inserting step.

16. The method according to claim 11, wherein a first one of the first defined operating position of the rotary armature and the second defined operating position of the rotary armature corresponds to an open position of the rotary armature and a second one of the first defined operating position of the rotary armature and the second defined operating position of the rotary armature corresponds to a closed position of the rotary armature.

17. The method according to claim 11, wherein in the first defined operating position of the rotary armature and the defined operating position of the first electromagnet, the rotary armature is positioned to bear on a pole face of the first electromagnet, and in the second defined operating position of the rotary armature and the defined operating position of the second electromagnet, the rotary armature is positioned to bear on a pole face of the second electromagnet.

18. The method according to claim 11, wherein in the first defined operating position of the rotary armature and the defined operating position of the first electromagnet, the rotary armature and the first electromagnet are separated by a first predetermined gap, and in the second defined operating position of the rotary armature and the defined operating position of the second electromagnet, the rotary armature and the second electromagnet are separated by a second predetermined gap.

19. A method for manufacturing an electromagnetic actuator, the actuator including:

two electromagnets, pole faces of the electromagnets at least partially facing each other;

a rotary armature configured to swivel between the pole faces, the rotary armature being configured to move into one of two limit positions in proximity to the pole faces when the electromagnet is energized;

a frame configured to accommodate the electromagnets and the rotary armature;

the method comprising the steps of:

inserting the electromagnets and the rotary armature into the frame;

fixing a swivel axis of the rotary armature in a bearing point in the frame;

moving the rotary armature into a first defined operating position;

moving a first electromagnet into a defined operating position relative to the rotary armature;

fixing the first electromagnet relative to the frame so that a spatial and angular position of the first electromagnet is fixed relative to the frame in the defined operating position;

moving the rotary armature into a second defined operating position;

moving a second electromagnet into a defined operating position relative to the rotary armature; and fixing the second electromagnet relative to the frame so that a spatial and angular position of the second electromagnet is fixed relative to the frame in the defined operating position;

wherein each of the first electromagnet and the second electromagnet is fixed relative to the frame in an area of a connecting stud fixed to the first electromagnet and the second electromagnet and protruding through a wall of the frame into an outer chamber.

20. The method according to claim 19, wherein the method further comprises the steps of:

connecting an end of the connecting stud protruding into the outer chamber to a connecting element, the connecting element bearing flatly on sections of the frame and displaceable relative to the frame in the spatial and angular position of the first electromagnet and the second electromagnet; and fixing the connecting element relative to the frame after the connecting step.

* * * * *